United States Patent [19]

Stewart

[11] 4,232,467

[45] Nov. 11, 1980

[54] SIGN SUPPORT STAKE

[76] Inventor: Robert Stewart, 12360 Riverside Dr., North Hollywood, Calif. 91607

[21] Appl. No.: 909,939

[22] Filed: May 26, 1978

[51] Int. Cl.[2] ..... G09F 07/20

[52] U.S. Cl. ..... 40/607; 248/533

[58] Field of Search ..... 40/607, 608, 606, 610, 40/617, 613, 156; 248/530–533, 539, 535

[56] References Cited

U.S. PATENT DOCUMENTS

| | | | |
|---|---|---|---|
| Re. 14,827 | 3/1920 | Norman | 40/606 |
| 2,022,160 | 11/1935 | Sorensen et al. | 40/607 |
| 2,552,745 | 5/1951 | Stanley et al. | 40/607 |
| 3,529,798 | 9/1970 | Williams et al. | 40/607 |

*Primary Examiner*—John F. Pitrelli

[57] ABSTRACT

A sign support stake whose main component takes the form of an elongated, sheet material member which has a hat-shaped configuration in cross-section. The elongated member is to have an irregularly shaped opening located in between a pair of upright projections. A first sign is to be supported by the upright projections. A brace member is to be secured to the elongated member in a crossed configuration. The brace member is to include a pair of spaced-apart hook projections. A second sign is to be supported by the hook projections and is to be fixedly secured to the elongated member through use of a fastener which is connected with the sign and the irregularly shaped opening of the elongated member.

2 Claims, 6 Drawing Figures

3 A

SIGN SUPPORT STAKE

BACKGROUND OF THE INVENTION

This invention relates to a sign supporting device and more particularly to a ground engaging post or stake designed to support one or more signs on each side of the stake and comprising a dual functioning offset brace and a dual functioning fastener for attaching signs thereto through apertures and projections embodied therein eliminating tools.

A main object of the invention is to provide a novel and inproved sign supporting stake which is simple and inexpensive to manufacture and easy to install in the ground and less time consuming to use.

A further object of the invention is to provide an improved sign support stake device employing new designed dual functioning offset brace or braces and dual functioning sign fasteners providing means for attaching and removing signs from a stake without the use of hand tools.

BRIEF DESCRIPTION OF THE DRAWING

FIG. 3A is a perspective view of the offset brace detailing the projecting sections embodied therein;

DETAILED DESCRIPTION OF THE PREFERRED EMBODIMENT

Figure 1:
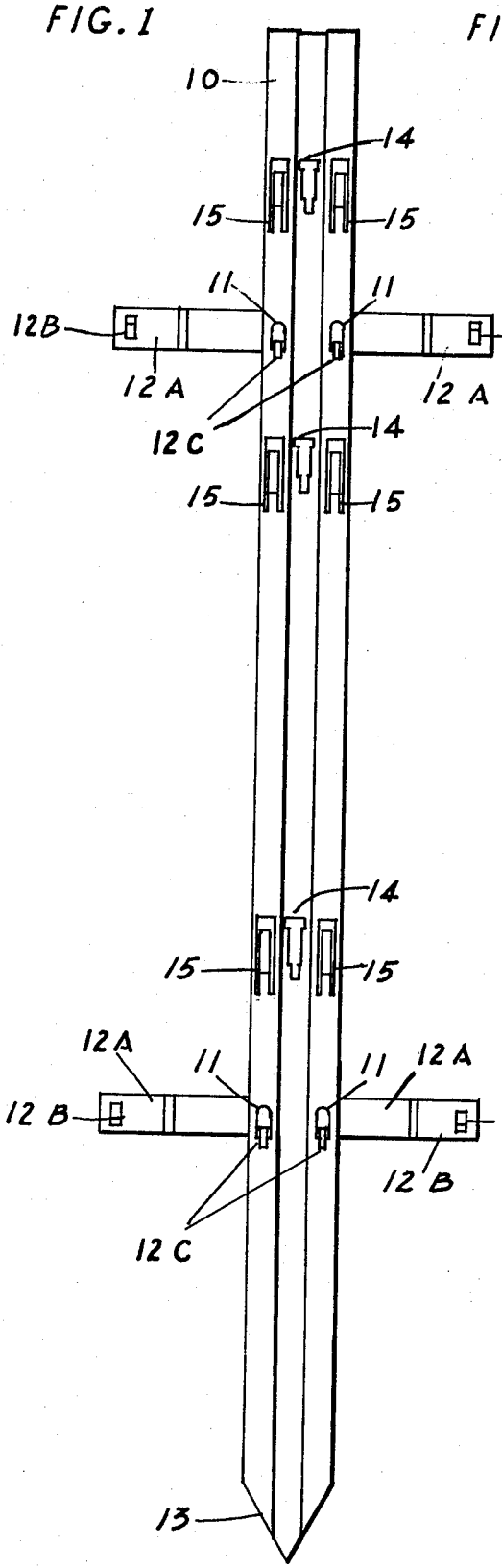
FIG. 1 is a front elevation view of a narrow elongated pointed sign supporting stake with offset braces attached thereto.
Figure 2:
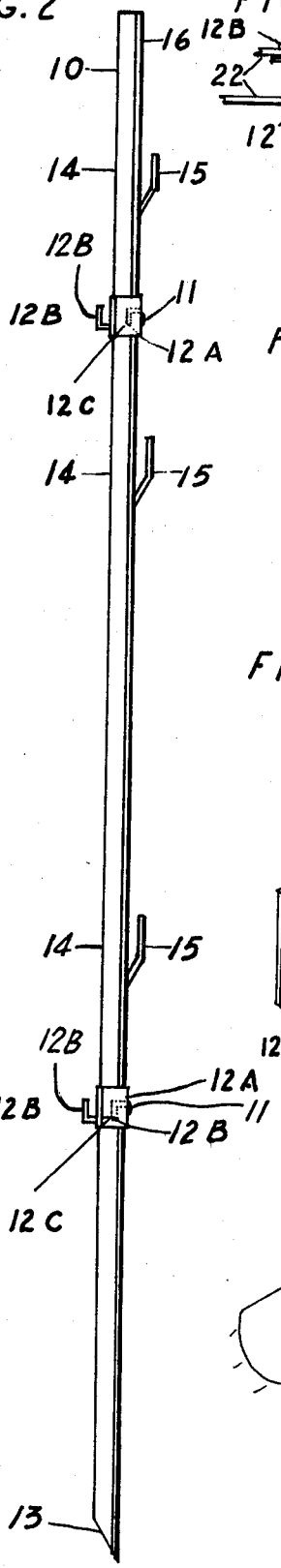
FIG. 2 is a side elevation view of this sign supporting stake device of FIG. 1.
Figure 3:
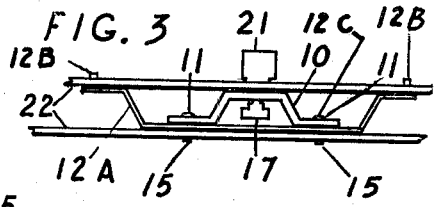
FIG. 3 a view observing the cross-sectional hat-shape formed stake with a offset brace attached thereto between the attached signs.
Figure 3:
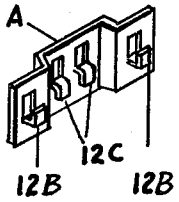
Figure 4:
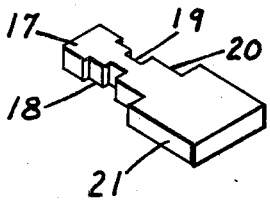
FIG. 4 is a perspective view of a new designed dual functioning sign attaching fastener employed herein.

Now referring to the drawings, 10 designates the front side of a narrow, elongated, roll formed, hat shaped in cross-section, support stake device with a pointed end 13 for easy ground penetration. Positioned at the upper and lower sections of the stake and projecting laterally beyond the edges thereof are a pair of offset braces 12A attached to the back side of the stake 16 by partially stamped out projecting sections embodied within the brace as in FIG. 3A herein referred to as attaching hooks 12C. However, one brace can be used per stake and perform both functions as now described:

First attach the brace to the back side of the stake 16 in the lower section of the stake by passing the hooks 12C thru openings 11 in the stake and pressing downward into a holding position attached flat against the stake and positioned horizontally to be engaged by the foot of the person driving the stake into the ground. Then remove the brace and attach it to the back side of the upper section of the stake in the same manner. Whereupon the brace 12A becomes a support at the back sides of the signs 22 that are flat against the brace and thereby preventing them from swinging in a strong wind and becoming damaged. Futhermore, in each end of the brace is a partially stamped out section embodied within the part and protruding in an upright position therefrom, shown in FIG. 3A, are hooks 12B which are designed to receive the bottom edge of the top sign when it is attached to the stake 10 on the front side thereby preventing the sign from tilting out of a true horizontal position on the stake.

When attaching signs to the front side of the stake 10, pass the end 17 of the fastener 21 through the horizontal slot 23 in the center of the sign 22 and into an opening 14 in the front side of the stake 10. The depth of the penetration of the fastener 21 will be determined by the thickness of the sign 22 material and this also will determine which slot 18 or 19 in the fastener 21 engages the sides of the graduated opening 14 in the stake thereby allowing the fastener 21 with sign to slide downward into a secure holding position on the stake. The notches 18 and 19 in the fastener 21 are designed so signs of differing thicknesses can be attached to the front side of the stake 10 using only the one fastener, to remove the signs reverse the procedure.

The opening 14 in the stake is also used to pass a bolt through when attaching a sign to the stake for a prolonged period of time. When attaching signs to the back side 16 of the stake 10, position the elongated slots 24 in the center of a sign 22 over the upright projections 15 protruding from the back sides in the stake 16 and press the sign downward into a holding position in between the stake and the upright projections protruding therefrom as in FIG. 5 as indicated at 15. Also the round opening 25 in the center of the sign 22 is used when attaching signs with a bolt and nut.

Figure 5:
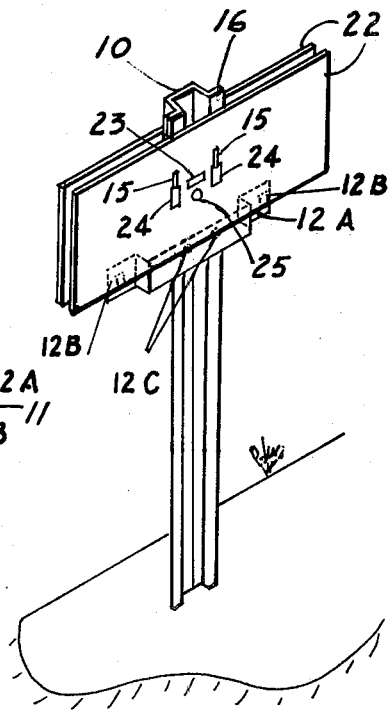
FIG. 5 is a perspective view of the sign supporting stake in the ground with two signs attached, one on each side of the stake and separated by a brace attached to the stake as herein described.

FIG. 5 shows the offset brace 12A attached in position to the stake in between the signs 22 with the bottom half of the brace 12A extending below the bottom edge of the attached sign 22, thereby allowing the lower attached bottom signs to back up to the brace 12A when attached thereby preventing them from swinging in a strong wind and becoming damaged.

Now then due to the special designed openings within the signs that are employed with matching holding devices employed in this invention, it is hereby requested that the signs be included along with the stake, brace and fastener as a part of this invention as herein described.

It is evident that additional signs can be attached to a support stake by increasing the number of openings with in the stake or projections protruding from the back side or from both the front and the back side of the stake.

I claim:

1. A sign support stake comprising:

an elongated member having a substantially hat-shaped configuration in cross-section forming a U-shaped center section with a depending flange extending laterally from each side of said center section, said U-shaped center section having an irregularly shaped opening, each said depending flange having an upright projection;

a longitudinal brace member being secured to said elongated member in a crossed configuration, said brace member having substantially equal length sections extending from said elongated member, each said section having a hook projecting therefrom, whereby a separate sheet sign structure is to be capable of being supported by said hook projections on one side of said elongated member with another sheet sign structure to be capable of being supported by said upright projections on the opposite side of said elongated member; a fastener to connect with said irregularly shaped opening, said fastener to extend through an opening in said another sheet sign structure and secure such to said elongated member, said fastener having a plurality of matching sets of apposing notches, a particular said matched set of apposing notches is to interconnect with said irregularly shaped opening for a particular thickness of said another sheet sign structure.

2. The sign support stake as defined in claim 1 including:

a second brace member being attached to said elongated member, said second brace member being adapted to be contacted by the foot of the operator to cause insertion of said elongaged member within the ground.

* * * * *